United States Patent [19]

Vogel et al.

[11] Patent Number: 4,574,604

[45] Date of Patent: Mar. 11, 1986

[54] PROCESS AND APPARATUS FOR HIGH SPEED FABRICATION OF COPPER WIRE

[75] Inventors: Ralph A. Vogel, Three Rivers, Mich.; Keith E. Caudill, Fort Wayne, Ind.

[73] Assignee: Essex Group, Inc., Ft. Wayne, Ind.

[21] Appl. No.: 671,275

[22] Filed: Nov. 13, 1984

[51] Int. Cl.[4] ..... B21B 9/00

[52] U.S. Cl. ..... 72/38; 72/43; 72/128; 72/286; 148/11.5 R; 148/11.5 C; 148/11.5 A; 219/10.61 R; 219/156

[58] Field of Search ..... 72/38, 43, 44, 45, 279, 72/280, 286; 148/11.5 R, 11.5 A, 11.5 C; 219/10.41, 10.61 R, 156

[56] References Cited

U.S. PATENT DOCUMENTS

| | | | |
|---|---|---|---|
| 3,181,326 | 5/1965 | Hollingsworth | 62/286 |
| 3,605,466 | 9/1971 | Kilcoin | 72/43 |
| 3,826,690 | 7/1974 | Bleinberger | 72/286 |
| 3,842,643 | 10/1974 | Large | 72/286 |
| 3,952,571 | 4/1976 | Yokota | 72/286 |
| 3,962,898 | 6/1976 | Tillmann | 72/279 |
| 4,112,725 | 9/1978 | Yamaguchi | 72/128 |
| 4,280,857 | 7/1981 | Dameran | 72/286 |
| 4,326,400 | 4/1982 | Davydov | 72/286 |
| 4,365,790 | 12/1982 | Horvalt | 72/286 |

*Primary Examiner*—Leon Gilden

*Attorney, Agent, or Firm*—James M. Rashid

[57] ABSTRACT

A continuous process for high speed fabrication of wire comprises the steps of directing wire through a first set of drawing dies to reduce the wire diameter to an intermediate diameter, applying a lubricant to the wire during the drawing process, annealing the intermediate diameter wire while it is still coated with some of the lubricant, controlling the tensile forces and elongation of the wire during the anneal, and drawing the annealed intermediate diameter wire to a desired final diameter in a second set of dies. The process is partially well suited for fabricating fine copper wire having improved mechanical properties.

8 Claims, 2 Drawing Figures

PROCESS AND APPARATUS FOR HIGH SPEED FABRICATION OF COPPER WIRE

DESCRIPTION

1. Technical Field

The present invention relates to the fabrication of wire, and in particular to the fabrication of copper wire.

2. Background Art

Over the years, numerous attempts have been made to improve the mechanical properties and fabricability of copper wire used in electric current carrying applications. In some of these applications, the mechanical properties of copper wire are as important as the electrical properties. Mechanical properties which are generally of concern to users of copper wire include ultimate tensile strength, elongation and elastic limit. To obtain the optimum mechanical behavior in the wire, it is desired to maximize ultimate tensile strength and elongation, and to minimize elastic ratio. These mechanical properties are important because there are many uses of copper wire which require it to be dereeled from a supply source at high speeds, pulled through a series of damaging tension devices, wound and formed onto rectangular or round bobbins, forcefully manipulated around sharp rectangular terminals, and joined with any of a number of different methods.

Many of the attempts which have been made to improve the strength and fabricability of copper wire have utilized a combination of mechanical working and heat treatment methods. U.S. Pat. No. 4,280,857 describes one such combination wherein wire is continuously directed through a plurality of drawing dies, then through a heater for an in-process anneal, then through a final die to produce wire of the desired diameter. Other patents teaching variations of this basic processing sequence are U.S. Pat. Nos. 3,826,690, 3,842,643, 3,852,875, 3,941,619, 3,952,571 and 3,962,898.

Wire drawing is typically facilitated by using specially formulated lubricants. Application of these materials to the wire permit it to pass easily through the drawing dies with a minimum of friction and stress. Typically, the lubricant is continuously applied to the wire prior to its passage through each individual drawing die, and is removed from the wire prior to its passage through the in-process anneal by complicated cleansing apparatus, such as shown in U.S. Pat. Nos. 3,826,690 and 4,280,857. Lubricant is removed because some of these materials burn excessively during the anneal, producing potentially hazardous and excessive amounts of smoke. Also, volatilization of the lubricant may create an oxide of carbonaceous residue on the wire surface, which must be removed prior to additional drawing.

During the in-process anneal, the length of the wire extends due to thermal expansion. Additionally, since the tensile strength of the wire is lower when it is at the anneal temperature than when it is at room temperature, if a tensile load is exerted on the wire during the annealing process, there may be adcladitional wire elongation and possibly fracture of the wire. U.S. Pat. No. 2,932,502 shows one apparatus which compensates for any elongation of the wire which may take place during the anneal. This apparatus also minimizes the tensile forces which may be exerted on the wire while it is being annealed. Wire is wrapped several times around a rotating sheave before it passes through the anneal, and then is wrapped several times around another rotating sheave after it passes through the anneal. The two sheaves are connected to each other by differential gearing driven by an electric motor which independently adjusts the rotational speeds of the two sheaves, as required, to adjust the wire length and tension to the desired minimum level. Other patents showing means for maintaining wire tension are U.S. Pat. Nos. 3,328,554, 3,697,335, 3,826,690, and 4,280,857.

It is common in the fabrication of wire to use induction heating methods to anneal wire. In order to confine the induced current to the length of wire which is being annealed, two different methods have been devised to short out the electric current at the ends of this length, as shown in U.S. Pat. Nos. 3,328,554 and 3,826,690. In U.S. Pat. No. 3,826,690, a complicated arrangement of sheaves is utilized in order to obtain physical contact between the wire as it enters the annealer and exits the annealer. This contact short circuits the current which has been induced in the wire. In U.S. Pat. No. 3,328,554, the wire forms a loop inductively linked with an induction coil by passing over a first sheave, around a second sheave and back over the first sheave. The wire rides in one groove on the first sheave as it starts the loop, and in another groove on the first sheave as it completes the loop. While the sheaves are electrically nonconductive, the two grooves on the first sheave are electrically coupled to form a short circuited loop in which a current is induced which heats the wire. This patent also shows a similar short circuiting arrrangement with two loops of wire connected in series which are inductively linked to an induction transformer.

DISCLOSURE OF INVENTION

One object of the present invention is to provide an improved process and apparatus for fabricating wire at high speeds.

Another object of the present invention is to provide a process and apparatus for fabricating copper wire with improved mechanical properties.

Yet another object of the present invention is to provide a process and apparatus for fabricating copper wire in a reduced number of process steps. In accordance with the present invention, a process for continuous high speed fabrication of wire includes the steps of passing a continuous length of wire through a first die set to reduce the wire diameter to form an intermediate diameter wire; applying lubricant to the wire; annealing the wire while it is still coated with some of the lubricant; controlling the tensile forces on the wire during the annealing step; and directing the annealed wire through a second die set to form wire with a desired diameter. The process is particularly well suited for fabricating copper wire. The process is also suited for fabricating copper alloy wire and aluminum and aluminum alloy wire.

In one embodiment of the present invention, during the first annealing operation the lubricant on the wire vaporizes as the wire increases in temperature. The vapor forms a protective atmosphere around the wire which precludes the formation of oxides which normally form on the wire at the elevated annealing temperatures. The amount of lubricant on the wire is controlled as it enters the annealer to a thin film which produces virtually no smoke when the wire is annealed. Preferably, the first annealing operation takes place within a sealed chamber. Heating the wire within the chamber vaporizes the lubricant to create a non-oxidizing atmosphere within the chamber.

In accordance with a preferred embodiment of the present invention, the first annealer includes an induction heater. The wire to be annealed makes two loops around spaced apart rotating sheaves, both loops passing through the core of the induction heater. This two loop arrangement increases the length of wire through which the induced current is traveling, which insures that the required amount of heating takes place during the anneal. Additionally, the wire is directed around the sheaves in such a manner that the wire entering the annealer is in physical contact with the wire exiting the annealer, which is at or near the annealing temperature, for about a 90° arc. This contact forms a two loop shorted secondary winding within the induction heater. The contact also produces a significant amount of conductive heat transfer from the hot to the cold wire.

In order to minimize the tensile forces on the wire during the first annealing operation, the wire is wrapped around a rotating capstan immediately before it enters the annealer, and is wrapped around the same capstan immediately after it exits the annealer. Lubricating means are located to apply lubricant to the wire wound on the capstan. The tangential speed of the capstan is about 2–8% greater than the linear speed of the wire wrapped thereon. Because of the presence of the lubricant on the wire and the higher speed of the capstan, the wire is able to slip on the capstan. This arrangement eliminates the danger of wire breakage due to excessive tensile forces and prevents significant elongation of the wire during the anneal. It also is considerably simpler and more reliable than prior art tension control devices which used two capstans connected by differential gearing.

The foregoing and other objects, features and advantages of the present invention will become more apparent in the light of the following detailed description of the preferred embodiments thereof as illustrated in the accompanying drawing.

BEST MODE FOR CARRYIMG OUT THE INVENTION

Figure 1:
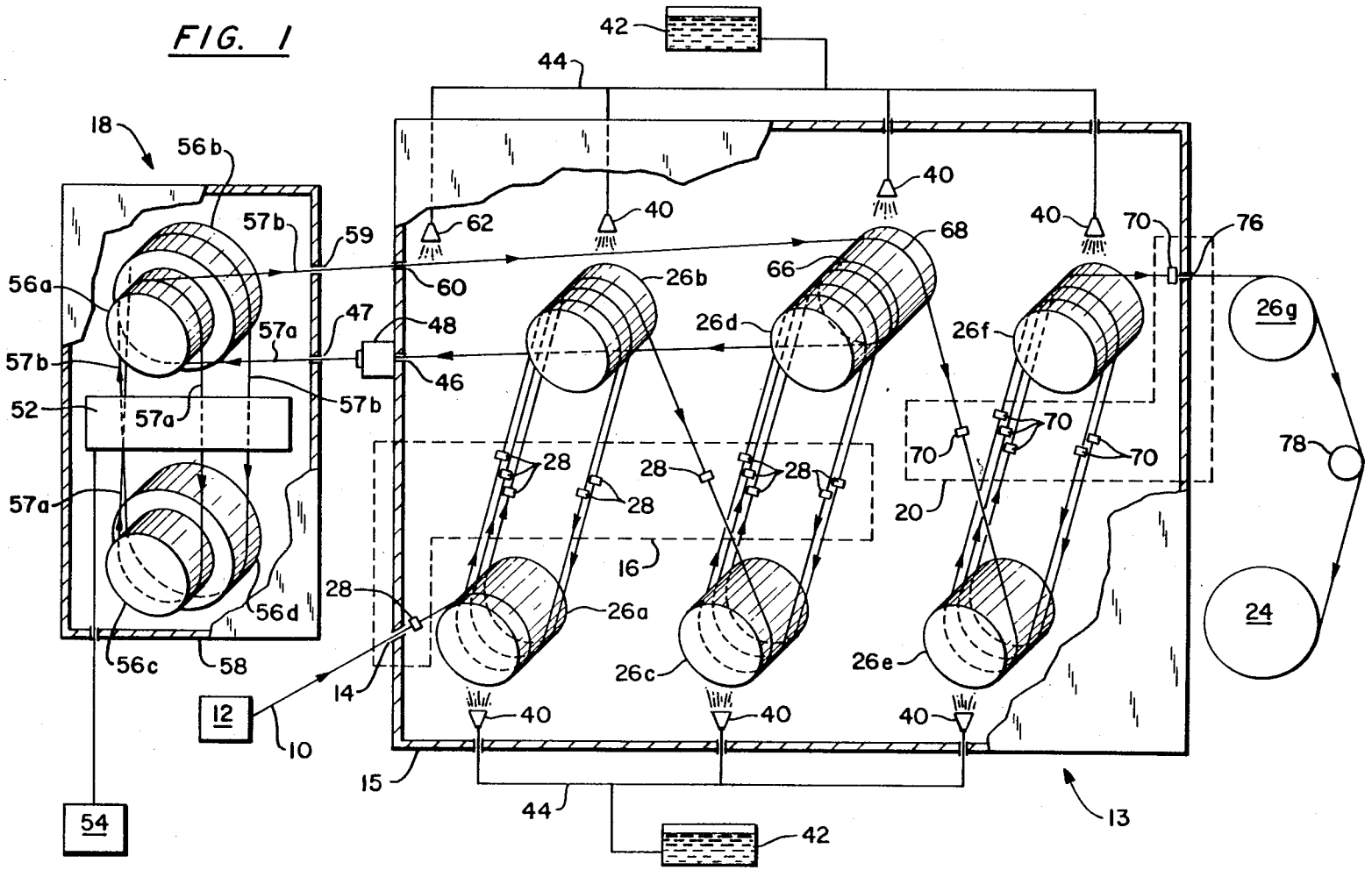
FIG. 1 is a schematic drawing of an apparatus for high speed fabrication of wire, illustrating the method and apparatus of the present invention.

Referring to FIG. 1, wire 10 is continuously directed from a supply 12 sequentially through a first die set 16 in a wire drawer 13, through an annealer 18, through a second die set 20 in the wire drawer 13, and then, the final diameter wire is wound onto a spool 24 or the like. Both die sets 16, 20 which are part of the wire drawer 13, are contained inside a wire drawing chamber 15.

More specifically, the wire 10 is pulled by capstans 26*a*, 26*b*, 26*c* and 26*d* from the source 12 through an aperture 14 in the drawing chamber 15 and through the first die set 16 containing a plurality of individual wire drawing dies 28 of successively smaller diameter drawing orifices. Passage of the wire through the first die set 16 produces wire having an intermediate diameter less than the original diameter. Preferably, the intermediate diameter is about 7 to 23% of the original diameter. Four to twelve individual dies could be used in the first die set 16, depending on the diameter of wire being fabricated. Lubricating nozzles 40 apply wire drawing lubricant onto the capstans 26*a*, 26*b*, 26*c*, 26*d* and onto the wire prior to its passing through each drawing die 28. A lubricant reservoir 42 supplies lubricant through conduits 44 to each of the lubricating nozzles 40. One lubricant which has proven to work satisfactorily is a synthetic material, Lusol W.D.7 F (1% fat concentrate in water, as determined by the Babcock test), purchased from Anderson Oil and Chemical Company, Portland Conn.

After passing through the first die set 16, the wire is wrapped several times around the capstan 26*d* to form a wrap 66, and then passes through a wiping device 48 located between the annealer 18 and wire drawer 13. The wiper 48 removes all but a thin film of lubricant from the wire. In this exemplary embodiment, the wiping device 48 directs pressurized air at 50 pounds per square inch against the wire to blow excess lubricant from it.

As the wire is heated in the annealer, the thin film of lubricant thereon is vaporized. This vapor forms a protective atmosphere around the wire which precludes oxidation of the wire which normally occurs at the elevated annealing tempertures. In this preferred embodiment, the annealer 18 is surrounded by a chamber 58. The chamber is substantially sealed except to permit entry and exit of the wire through the apertures 47 and 59, respectively. When the lubricant on the wire vaporizes, the vapor is substantially contained within the sealed chamber. The vapor tends to purge the chamber of any oxygen within it, providing a more effective means for ensuring that there is no oxidation of the wire during the anneal.

The annealer 18 includes a transformer core 52 having an induction coil electrically connected to a 400–600 Hz. source of alternating current 54. We have found that if the intermediate diameter wire makes two loops through the transformer core 52, the desired amount of annealing is obtained in copper wire of a diameter between about 0.003 and 0.050 inches traveling therethrough at about 2,400 feet per minute. Use of too low a frequency of alternating current produces "cold spots" in the wire, i.e., localized areas along the wire length where the induced current is not sufficient to produce the required amount of annealing. Mechanical and electrical properties of wire with cold spots are not constant along the length of the wire, which is undesirable.

A preferred annealing temperature is in the range of 650 to 800 degrees Fahrenheit. The exact temperature selected depends on the precise composition of the wire, the length of time in the anneal and the amount of plastic deformation in the intermediate diameter wire.

As the wire moves through the transformer core 52, a current is induced therein, and the wire is heated and annealed. The two loop path of wire travel through the coil is defined by four electrically insulated sheaves 56*a*, 56*b*, 56*c*, and 56*d*. Each of the four sheaves has a circumferential groove of a shape which will maintain the moving wire therein. All sheaves are able to rotate independently of each other. The sheaves are arranged so that the wire entering the annealer 18 enters the groove of the sheave 56*a* and remains in contact with the sheave 56*a* for approximately 270°. The wire then passes sequentially around the sheaves 56*c* and 56*b*, to form a first loop of wire 57*a* passing through the transformer core 52. From the sheave 56*b*, the wire passes around the sheave 56*d* and returns to the sheave 56*a* to form a second loop of wire 57*b* passing through the transformer core 52. The second loop 57*b* passing around the sheave 56*a* contacts the first loop 57*a* on the sheave 56*a* for approximately 90°. The physical contact between the cool entering wire and the hot exiting wire on the sheave 56*a* forms a two loop shorted secondary winding in which is induced a circulatory current which heats the wire in the loop; additionally it results in conductive heat transfer from the second loop portion of wire to the first loop portion of wire. The wire then exits from the annealer 18 and enters the wire drawer 13.

In this exemplary embodiment we made two loops of the intermediate diameter wire in the annealer 13. It should be recognized, however, that a single loop of wire or a plurality of loops of wire could be made around the rotating sheaves. Regardless of the number of loops of wire made in the annealer, the cool wire entering the annealer must contact the hot wire exiting the annealer on one of the sheaves to form a shorted secondary winding in which is induced a circulatory current and which results in conductive heat transfer from the hot wire to the cool wire.

After the wire reenters the wire drawer 13, but before it passes through the second set of dies 20, it moves past a quenching device 62. The quencher 62 applies a coolant to the heated wire to reduce its temperature and to prevent any oxidation when the wire is exposed to the air atmosphere. The wire should be cooled to below about 300 degrees Fahrenheit. Wire drawing lubricant from a source 42 is the preferred coolant to quench the annealed intermediate diameter wire.

After the wire is quenched by the device 62, it is wrapped on the rotating capstan 26*d* to form a wrap 68. The tangential speed of the capstan 26*d* is about 2–8% greater than the linear speed of the wire, and the lubricated wire wraps 66, 68 slip, as necessary, on the capstan 26*d* to control the tension of the wire and to prevent significiant elongation of the wire during the anneal. Slip of the wire of the wraps 66, 68 is assisted by the lubricant retained on the wire. The number of turns in the wraps 66, 68 is selected to maintain low tensile forces on the wire and to prevent significant elongation of the wire during the first annealing operation. A wrap may contain several turns of wire or only a partial turn.

From the wrap 68, the wire passes around the capstans 26*e* and 26*f* which pull it through the second die set 20 containing a plurality of individual wire drawing dies 70 of successively smaller diameter orifices to produce wire of a desired final diameter. Four to eight individual dies could be used in the second die set 20, depending on the desired final diameter of wire. Lubricating nozzles 40 apply a wire drawing lubricant onto the capstan 26*e*, 26*f* and onto the wire prior to its passage through each drawing die 70. Lubricant reservoir 42 supplies lubricant through conduits 44 to each of the lubricating nozzles 40. The number and sizes of the drawing dies 28, 70 in the first and second die sets 16, 20 are selected to avoid producing unneccesary stress in the wire during the drawing process. Preferably, the final diameter of the wire produced is less than about 10% of the original wire diameter.

The wire is finally passed over the capstan 26*f*, through the aperture 76 in the chamber 15 and around an output capstan 26*g* which pulls the wire out of the wire drawing chamber 15. The capstan 26*g* feeds the final diameter wire to a traverse pulley 78 that is reciprocated on its axis in a conventional manner to direct the wire onto the spool 24.

Figure 2:
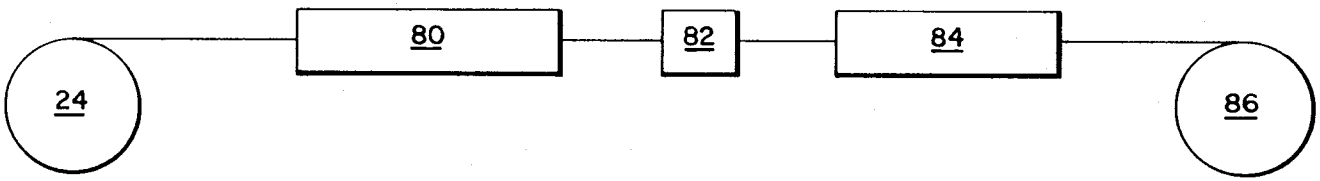
FIG. 2 is a schematic drawing of an annealer and wire coating apparatus to be used in the fabrication of coated wires in accordance with the present invention.

In a subsequent processing step illustrated in FIG. 2, the final diameter wire is withdrawn from the spool 24 and continuously passed through an oven type annealer 80 for a second anneal. The annealer heats the wire to an annealing temperature in the range of 650 to 800 degrees Fahrenheit. After the second anneal, the wire passes through an enamel applicator 82 where a suitable insulation coating is applied to the wire and then hardened by drying or curing in an enameling oven 84. The wire can be repeatedly passed through the applicator 82 and the oven 84 until a desired number of layers of insulation have been applied and hardened. The enameled wire is then wound on a spool 86. While the second annealer 80, enameler 82 and enameling oven 84 are shown in FIG. 2 as being separate from the wire drawer 13, they may be located in-line with the wire drawer 13. As such, the wire would be directed from the capstan 26*g* through the second annealer 80, enameler 82 and enamel oven 84, and then wound on the spool 24.

The present invention is particularly well suited for fabricating fine copper wire having a diameter between 0.003 and 0.020 inches. We have fabricated 0.003–0.008 inch diameter copper wire according to the teachings of the present invention at production rates of 11,000 feet per minute.

The mechanical properties of copper wire produced according to the present invention were found to be considerably better than those previously obtained. The following table presents data averaged from numerous tests conducted on 0.003 inch diameter copper wire. In "Process A", the wire was not given the in-process anneal of the present invention. "Process B" is the process of the present invention as shown and described with respect to FIG. 1, with the addition of a second, final anneal. In fabricating this wire, twelve individual dies were used in the first die set 16 and seven individual dies in the second die set 20. The wrap 66 had $1\frac{2}{3}$ turns of wire and the wrap 68 had $\frac{1}{4}$ of a turn of wire. The tangential speed of capstan 26*d* was about 4% greater than the linear speed of the wire. It is believed that copper wire produced according to the present invention and having a diameter between 0.003–0.020 inches would have similar mechanical properties. The wire made by Process A and Process B was uncoated.

| Wire Property | Process A | Process B |
|---|---|---|
| Ultimate Tensile Strength, ksi | 35 | 38 |
| Elongation, % | 24 | 32 |
| Elastic Ratio, % | 89 | 75 |

Although the invention has been shown and described with respect to the preferred embodiments thereof, it should be understood by those skilled in the art that various changes and omissions in the form and detail may be made therein without departing from the spirit and scope of the invention.

We claim:

1. A process for continuous high speed fabrication of wire, comprising the steps of:

(a) passing a continuous length of wire at a constant speed through a first die set to reduce the wire diameter to form an intermediate diameter wire;

(b) applying a lubricant to the wire while it passes through the first die set;

(c) wrapping the lubricated intermediate diameter wire on a capstan which rotates at a speed which is faster than said constant speed of the wire to form a first wrap of wire;

(d) passing the lubricated wire of the first wrap at said constant speed from the capstan through an annealer;

(e) annealing the intermediate diameter wire in a non-oxidizing atmosphere within the annealer;

(f) quenching the annealed intermediate diameter wire;

(g) wrapping the quenched annealed intermediate diameter wire on said capstan to form a second wrap of wire, the number of turns in the first and second wraps selected to maintain low tensile forces on the wire within the annealer and to prevent significant elongation of the wire during said step of annealing, wherein said capstan pulls the wire through the annealer; and (h) passing the wire of the second wrap at said constant speed from the capstan through a second die set to form the wire to a final diameter.

2. The process of claim 1 wherein the tangential speed of said capstan is at least 2% greater than said constant speed of the wire.

3. The process of claim 1 wherein said annealing operation includes annealing the intermediate diameter wire in an induction heater and directing the intermediate diameter wire around rotating sheaves to form at least one loop which passes through the induction heater, the cool wire entering the annealer contacting the hot wire exiting the annealer of one of the sheaves to form a shorted secondary winding within the induction heater and to conductively transfer heat from the hot wire to the cool wire.

4. The process of claim 3 wherein said annealing operation includes annealing the intermediate diameter wire in an induction heater and directing the intermediate diameter wire around rotating sheaves to form two loops which pass through the induction heater, the beginning portion of the first loop contacting the ending portion of the second loop on one of the sheaves to form a two loop shorted secondary winding within the induction heater and to conductively transfer heat from the ending portion of the second loop to the beginning portion of the first loop.

5. The process of claim 3 wherein said annealing operation vaporizes the lubricant on the wire, the vaporized lubricant forming said non-oxidizing atmosphere around the wire during said annealing operation.

6. The process of claim 3 further comprising the step of controlling the amount of lubricant on the wire as it enters the annealer to a thin film which produces virtually no smoke when the wire is heated in said annealing operation.

7. The process of claim 1 further comprising annealing the final diameter wire.

8. Copper wire produced by the process of claim 7 wherein the wire has a final diameter less than 0.020 inches, an elastic ratio less then 75%, an ultimate tensile strength of at least 38 ksi and an elongation of at least 32%.

* * * * *

UNITED STATES PATENT AND TRADEMARK OFFICE

CERTIFICATE OF CORRECTION

PATENT NO. : 4,574,604

DATED : March 11, 1986

INVENTOR(S) : Ralph A. Vogel and Keith E. Caudill

It is certified that error appears in the above-identified patent and that said Letters Patent is hereby corrected as shown below:

In the Abstract, line 10, "partially" should be --particularly--

Column 1, line 60, "adcladitional" should be --additional--

Signed and Sealed this

*Twenty-second* Day of *July 1986*

[SEAL]

*Attest:*

DONALD J. QUIGG

*Attesting Officer*

*Commissioner of Patents and Trademarks*